US007857019B2

(12) United States Patent
Willis

(10) Patent No.: US 7,857,019 B2
(45) Date of Patent: Dec. 28, 2010

(54) SYSTEM AND METHOD FOR CUTTING A PROFILE IN A WORKPIECE

(76) Inventor: Phillip Freeman Willis, 10741 Highway 52 West, Westmoreland, TN (US) 37186

( * ) Notice: Subject to any disclaimer, the term of this patent is extended or adjusted under 35 U.S.C. 154(b) by 267 days.

(21) Appl. No.: 12/156,705

(22) Filed: Jun. 3, 2008

(65) Prior Publication Data

US 2009/0293992 A1 Dec. 3, 2009

(51) Int. Cl.
*B27C 5/00* (2006.01)

(52) U.S. Cl. ..... 144/134.1; 144/135.2

(58) Field of Classification Search ..... 144/1, 144/2.1, 3.1, 114, 117, 129, 130, 134.1, 135.2, 144/145.2, 253.21, 85–89, 82, 67, 69–71, 144/135.3, 90.1, 91, 91.2, 286.1, 286.5; 83/47, 83/368, 371, 367, 360; 409/138, 157, 192, 409/229

See application file for complete search history.

(56) References Cited

U.S. PATENT DOCUMENTS 2,381,807 A * 8/1945 Davis et al. ..... 409/131
2,510,820 A * 6/1950 Hermanson ..... 409/138
2,751,944 A * 6/1956 Schrag et al. ..... 144/134.1
3,483,904 A * 12/1969 Jacumin ..... 144/386
3,538,968 A * 11/1970 Gluck ..... 144/371
3,717,186 A * 2/1973 Davis ..... 144/145.2
4,131,143 A * 12/1978 Mayo ..... 144/30
4,243,081 A * 1/1981 Pritelli ..... 144/392
4,328,847 A * 5/1982 King, Sr. ..... 144/368
4,655,268 A * 4/1987 Lundblom ..... 144/3.1
4,677,726 A * 7/1987 Williams ..... 29/401.1
4,741,370 A * 5/1988 Heaton ..... 144/135.2
4,944,339 A * 7/1990 Luyten ..... 144/363
5,103,880 A * 4/1992 Rice et al. ..... 144/3.1
5,137,066 A * 8/1992 Dimter ..... 144/2.1
5,443,103 A * 8/1995 Kopacz et al. ..... 144/3.1
5,494,089 A * 2/1996 Lubbe ..... 144/144.1
5,577,428 A * 11/1996 Rueb ..... 83/449
5,592,793 A * 1/1997 Damratowski et al. ..... 52/182
5,706,568 A * 1/1998 Nenadic et al. ..... 29/563
6,092,446 A * 7/2000 Hardesty ..... 82/148
6,651,541 B2 * 11/2003 Faircloth ..... 83/733
6,817,392 B2 * 11/2004 Phillips ..... 144/39
2007/0267103 A1 * 11/2007 Miller et al. ..... 144/363

* cited by examiner

*Primary Examiner*—Dana Ross
*Assistant Examiner*—Jennifer Chiang
(74) *Attorney, Agent, or Firm*—Michael E. McKee

(57) ABSTRACT

A system for cutting a profile along a linear edge of a wooden workpiece utilizes two spaced-apart rotatable cutting tools which are mounted for rotation in opposite rotational directions and a support surface for supporting the workpiece for movement along each of the two cutting tools. By positioning the workpiece upon the support surface so that the linear edge thereof extends between the two cutting tools, the workpiece can be moved into cutting engagement with a first of the cutting tools and subsequently into cutting engagement with the second of the cutting tools. By subsequently reversing the movement of the workpiece along the first cutting tool before the cutting edges thereof exit a trailing (side) edge of the workpiece, the likelihood that the workpiece will be damaged from the profile-forming process is reduced.

13 Claims, 6 Drawing Sheets

SYSTEM AND METHOD FOR CUTTING A PROFILE IN A WORKPIECE

BACKGROUND OF THE INVENTION

This invention relates generally to the removal of material from a workpiece possessing grains or other patterns of fibrous tissue, such as a wooden workpiece, and relates, more particularly, to means and methods for cutting a profile, or cope, along the edge of such a workpiece.

The class of apparatus with which this invention is to be compared includes those which possess support means for supporting a workpiece, such as a wooden workpiece, for working thereon and a rotatable cutting tool having cutting edges which are intended to cut a profile in the workpiece (e.g. typically along an edge of the workpiece) as the workpiece and the rotating cutting tool are moved relative to one another so that the cutting tool removes, or cuts away, material from the workpiece to form a desired profile in the workpiece.

Heretofore and when cutting a workpiece, such as a wooden workpiece, the workpiece may be splintered or experience similar damage by the cutting edges of the cutting tool being used to cut the workpiece. For example, such damage may involve the tearing out of portions of a workpiece which are not desired to be removed therefrom and have commonly resulted as the cutting edges of the cutting tool moves out of cutting engagement with the workpiece (i.e. as the cutting tool exits a trailing edge of the workpiece) during a profile-forming operation. To reduce the likelihood that the workpiece would be damaged by such an occurrence, a sacrificial workpiece can be placed in abutting relationship with the trailing edge of the workpiece to effectively lengthen the workpiece. With a sacrificial piece positioned adjacent the workpiece in this manner, any damage which would result as the cutting tool exits the workpiece or the sacrificial piece would, most likely, adversely effect the sacrificial piece, rather than the workpiece in which the profile is desired to be formed, or cut.

It would be desirable to provide an improved system and method for forming a profile in a workpiece, such as a wooden workpiece, which reduces the likelihood that the workpiece will be damaged by a cutting tool being used to cut the profile.

Accordingly, it is an object of the present invention to provide a new and improved system and method for cutting a profile in, or coping, a workpiece, such as a wooden workpiece.

Another object of the present invention is to provide such a system and method which, upon completion of a profile-cutting operation, yields a workpiece which will not likely be damaged by the cutting tool being used to cut the workpiece.

Still another object of the present invention is to provide such a system having an improved means for holding a workpiece in condition to be worked upon by a cutting tool of the system.

Yet another object of the present invention is to provide such a system whose workpiece holding means is adapted to apply uniform pressure across the width of the workpiece to be worked upon by the system.

A further object of the present invention is to provide such a system which employs means for moving the workpiece into cutting engagement with a cutting tool of the system and means for automatically limiting the distance that the workpiece can be advanced into a cutting tool of the system.

A still further object of the present invention is to provide such a system which is uncomplicated in structure, yet effective in operation.

SUMMARY OF THE INVENTION

This invention resides in a system and method for cutting a profile along the linear edge of a workpiece having two side edges between which the linear edge extends.

The system includes a pair of rotatable cutting tools which are supported for rotation about parallel axes and in a spaced-apart relationship with one another and having cutting edges so that when either of the cutting tools is rotated about its rotation axis and the linear edge of a workpiece is moved in cutting engagement with and along the cutting edges of the rotating cutting tool, material is removed from the workpiece to form a profile along the linear edge thereof. The system also includes means for supporting the workpiece in condition to be cut by the cutting tools as the linear edge of the workpiece is moved in cutting engagement with and along the cutting edges of the cutting tools and means for rotating the cutting tools in opposite rotational directions about the axes of rotation. By arranging the workpiece upon the supporting means so that the linear edge of the workpiece extends between the cutting tools and then moving the workpiece in an initial direction into cutting engagement with the cutting edges of one of the cutting tools so that a side edge of the workpiece which acts as the leading edge of the workpiece is the first edge of the workpiece to be engaged by the cutting edges of said one cutting tool, halting the movement of the workpiece in the initial direction before the cutting edges of said one cutting tool exit the workpiece through a side edge thereof which acts as the trailing edge, and then moving the workpiece in the direction opposite the initial direction so that material is removed from the workpiece by the other cutting tool, the workpiece is profiled along its entire length.

The method of the invention includes the steps for forming a profile along the linear edge of a workpiece. Such steps include the providing of a pair of rotatable cutting tools which are supported for rotation about parallel axes and in a spaced-apart relationship with one another and having cutting edges so that when either of the cutting tools is rotated about its rotation axis and the linear edge of a workpiece is moved in cutting engagement with and along the cutting edges of the rotating cutting tool, material is removed from the workpiece to form a profile along the linear edge thereof. The cutting tools are rotated in the opposite rotational directions about the axes of rotation, and the workpiece is supported so that the linear edge thereof extends between the rotating cutting tools. The workpiece is then moved in an initial direction into cutting engagement with the cutting edges of one of the cutting tools and so that a side edge of the workpiece which acts as the leading edge of the workpiece is the first edge of the workpiece to be engaged by the cutting edges of said one of the cutting tools. The movement of the workpiece in the initial direction is then halted before the cutting edges of said one of the cutting tools exits the workpiece through a side edge thereof which acts as the trailing edge thereof, and then the workpiece is moved in the direction opposite the initial direction so that material is removed from the workpiece by the other cutting tool.

DETAILED DESCRIPTION OF ILLUSTRATIVE EMBODIMENTS

Figure 1:
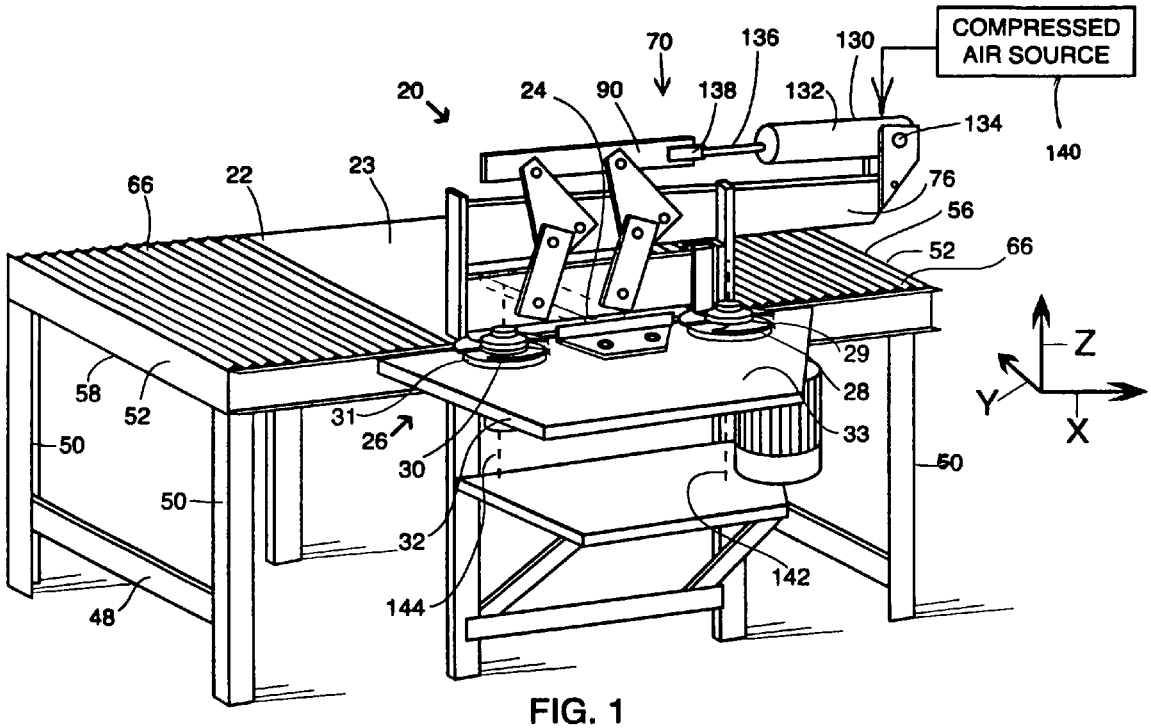
FIG. 1 is a perspective view of a workpiece-cutting system within which features of the present invention are embodied.
Figure 2:
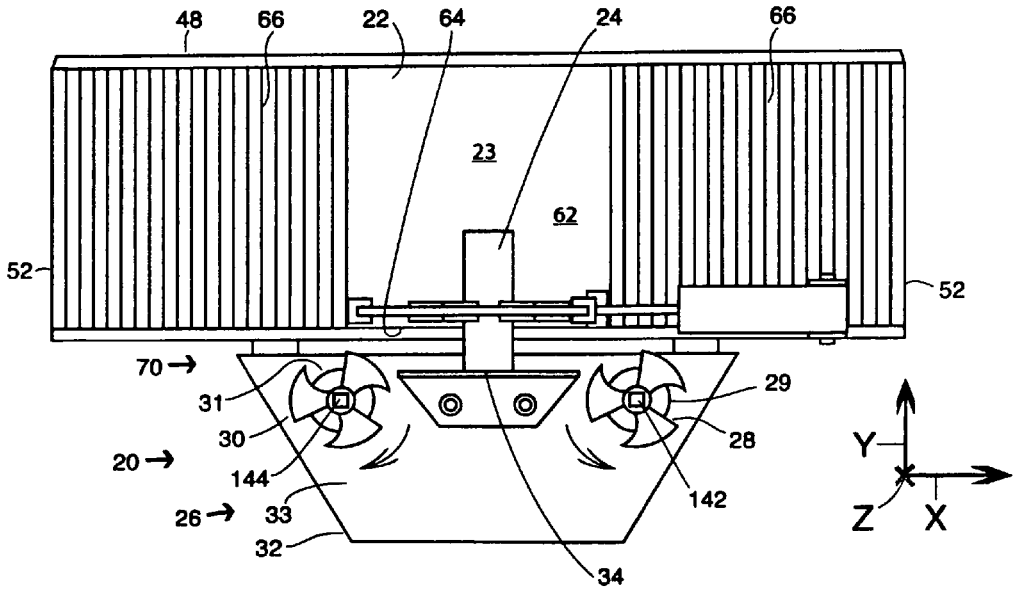
FIG. 2 is a plan view of the FIG. 1 system, as seen from above in FIG. 1.

Turning now to the drawings in greater detail and considering first FIGS. 1 and 2, there is illustrated an embodiment, generally indicated 20, of a system within which features of the present invention are embodied. The system 20 includes support means 22 defining a support surface 23 upon which a wooden workpiece 24 is supported and means, indicated 26, for cutting a desired profile along an edge of the workpiece 24 as the workpiece 24 is moved relative to and into cutting engagement with the cutting means 26. In the depicted system 20, the cutting means 26 includes two cutting tools, or heads 28, 30, which are each supported for rotation at one of two spaced-apart cutting stations, indicated 29 and 31, respectively, adjacent the support surface 23.

The support surface 23 is arranged in substantially a horizontal plane which corresponds, in this example, to the indicated X-Y coordinate plane. Each cutting head 28 or 30 is mounted for rotation at its corresponding cutting station 29 or 31 parallel to the indicated Z-axis (i.e. the coordinate axis which is normal to the plane of the support surface 23) adjacent the support surface 23 and its cutting edges mirror those of the other cutting head 30 or 28 so that the profiles capable of being cut in a workpiece 24 by the cutting heads 28 and 30 are identical to one another. As will be apparent herein, an amount of workpiece material is removed from the workpiece 24 by one of the cutting heads 28 or 30 as the workpiece 24 is moved in one direction along the X-coordinate direction (e.g. the positive X-coordinate direction) for a predetermined distance along the cutting head 28 or 30, and another amount of workpiece material is removed from the workpiece 24 by the other of the cutting heads 30 or 28 as the workpiece 24 is moved in the opposite direction along the X-coordinate direction (e.g. the negative X-coordinate direction) for a predetermined distance therealong so that the material removed from the workpiece 24 by both of the cutting heads 28 and 30 collectively forms the desired profile along the edge of the workpiece 24 being worked upon, or cut, by the cutting heads 28 and 30.

Positioned alongside the support surface 23 is a secondary table 32 having a tabletop 33 upon which the cutting heads 28 and 30 are rotatably mounted.

Figure 3:
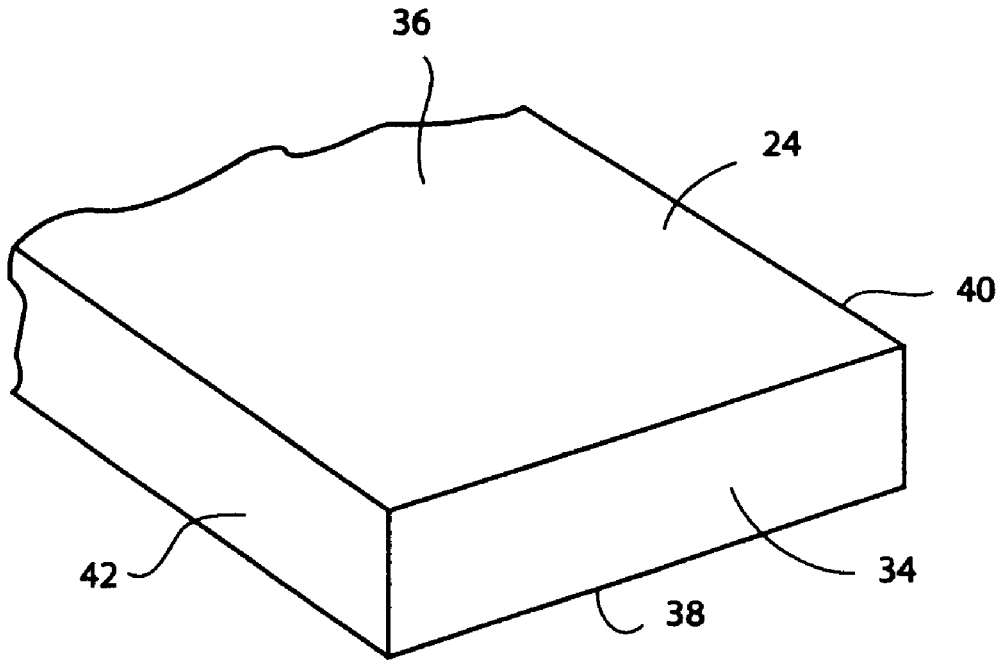
FIG. 3 is a perspective view of a fragment of a workpiece before a profile is cut along an edge thereof.

With reference to FIG. 3, there is illustrated an example of a workpiece 24 having a linear edge 34 which is capable of being worked upon, or profiled, by the cutting heads 28 and 30 during a profile-cutting operation. The depicted workpiece 24 is in the form of a wooden plank having flat upper and lower surfaces 36 and 38, respectively, and two side edges 40 and 42 between which the linear edge 34 extends. Each side edge 40 or 42 and linear edge 34 of the workpiece 24 defines a planar surface, and the planar surfaces defined by the side edges 40 and 42 are substantially normal to the planar surface defined by the linear edge 34. As will be apparent herein, when the linear edge 34 of the workpiece 24 is advanced into cutting engagement with the cutting head 28, the side edge 40 acts as the leading edge which first moves into cutting engagement with the cutting head 28, and when the workpiece 24 is advanced into cutting engagement with the other cutting head 30, the side edge 42 acts as the leading edge which first moves into cutting engagement with the cutting head 28. Although the depicted workpiece 24 is constructed of wood, the system 20 is well-suited for forming profiles along other workpieces possessing grains or patterns of fibrous tissue.

Figure 4:
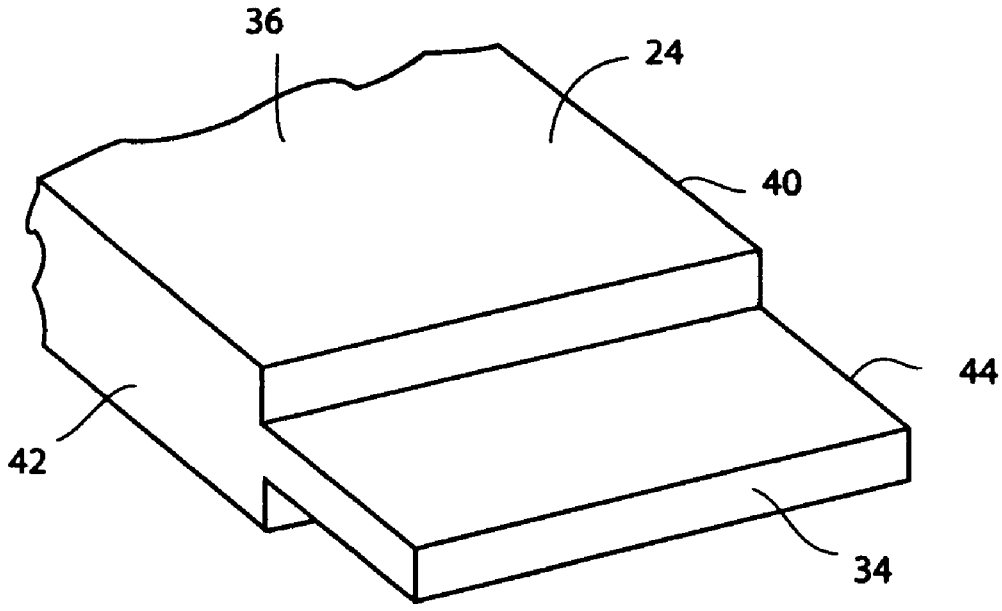
FIG. 4 is a perspective view of a fragment of a workpiece after a profile has been cut along an edge thereof.
Figure 5:
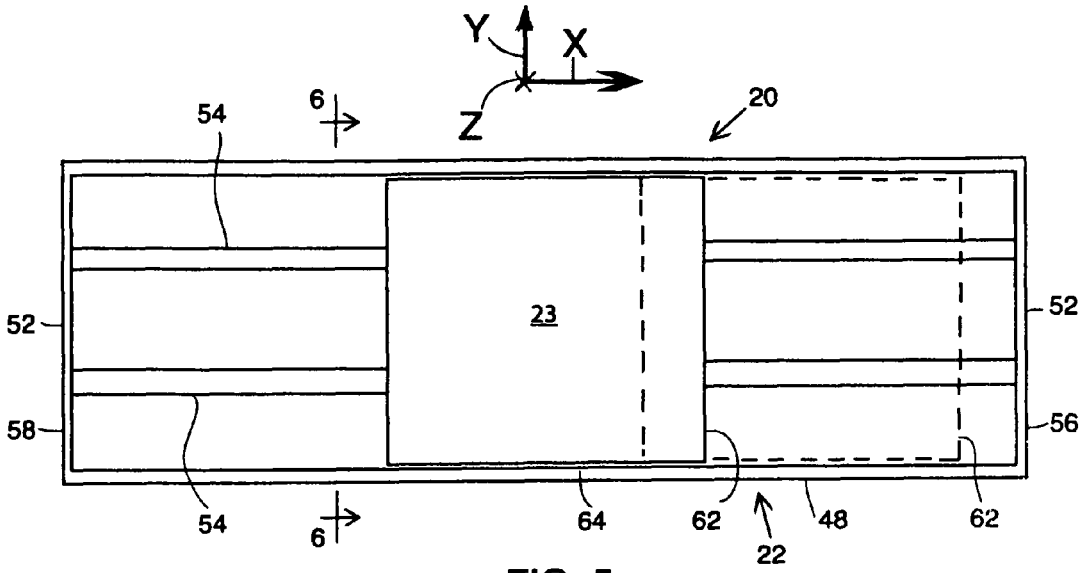
FIG. 5 is a plan view of the support table of the FIG. 1 system.

With reference to FIG. 4, there is shown the workpiece 24 after an exemplary profile has been formed along its linear edge 34. In this example, upper and lower sections of material have been removed from the workpiece 24 to leave a mid-portion, indicated 44, which protrudes from the remainder of the workpiece 24. Such a profile has been found to be well-suited for fit-up with other workpieces, such as components of doors or sections of hardwood flooring, which possess a complementary groove for accepting the mid-portion 44.

Figure 6:
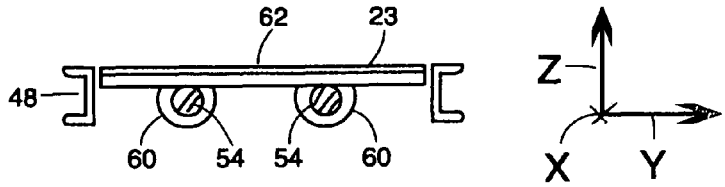
FIG. 6 is a cross-sectional view taken about along line 6-6 of FIG. 5.

With reference to FIGS. 1, 2, 5 and 6, the support means 22 of the depicted system includes a table-like frame 48 having a plurality of (i.e. at least four) legs 50 and a plurality of linear members 52 which are joined atop the legs 50 to define a substantially horizontal plane which is parallel to that of the support surface 23. A pair of parallel guide rails 54 (FIGS. 5 and 6) are joined to the linear members 52 situated at the opposite ends, indicated 56 and 58, of the frame 48 and extend along the indicated X-coordinate direction, and there is mounted upon the guide rails 54 a pair of bearing members 60 (FIG. 6) which can be slidably moved along the length of the guide rails 54. Mounted upon the bearing members 60 is a platen tabletop 62 whose upper surface provides the support surface 23 of the support means 22. Furthermore and as best shown in FIGS. 2 and 6, the tabletop 62 defines a side edge 64 which is disposed closest to the cutting heads 28 and 30.

With reference again to FIG. 5, it follows that the tabletop 62 can be moved relative to and along the frame 48 in the indicated positive and negative X-coordinate directions as the bearing members 60 are slidably moved along the length of the guide rails 54. Consequently, the tabletop 62 can be moved along the frame 48 between, for example, the solid line position depicted in FIG. 5 and the phantom-line position depicted in FIG. 5. Meanwhile, the side edge 64 of the tabletop 62 is disposed in such a relation to the cutting heads 28, 30 (FIG. 2) that as the tabletop 62 is moved relative to the frame 48 along either the positive or negative X-coordinate direction, the side edge 64 of the tabletop 62 clears (i.e. is spaced from) the cutting edges of the cutting heads 28, 30. It follows that in order to work upon a workpiece 24 with the cutting heads 28, 30, the workpiece 24 is positioned in a stationary condition upon the tabletop 62 so that the linear edge 34 of the workpiece 24 (i.e. the edge of the workpiece 24 to be worked upon by the cutting heads 28, 30) overhangs the tabletop edge 64 and the support surface 23 can be moved past either of the cutting head 28 or 30 to move the workpiece 24 into cutting engagement with the cutting edges of the cutting head 28 or 30.

Attached between the frame ends 56 and 58 and the corresponding sides of the movable tabletop 62 are accordion-like covers 66 which collapse or expand, as necessary, as the tabletop 62 is moved toward one of the frame ends 56 or 58. Inasmuch as the system 20 is used to remove (i.e. cut) material from a wooden workpiece 24 in a manner which may propel wood chips in any of a number of directions, it has been found that these covers 66 help maintain the guide rails 54 in a relatively clean condition. It will also be understood that the secondary table 32 (upon which the cutting heads 28 and 30 are positioned) is fixedly attached to the frame 48 along one side thereof.

As an alternative to utilizing the depicted accordian-like covers 66, the expanse of the tabletop 62 can be increased along the X-coordinate direction (by, for example, the addition of smooth-surfaced sheet metal pieces to each side of the support surface 23) so that as the tabletop 62 is moved relative to and along the length of the guide rails along an X-coordinate direction, the additional expanse of the tabletop is moved along the X-coordinate direction, as well. Such a tabletop of increased size (i.e. expanse) can be advantageous in that it provides a larger worktable for a user of the system.

Figure 7:
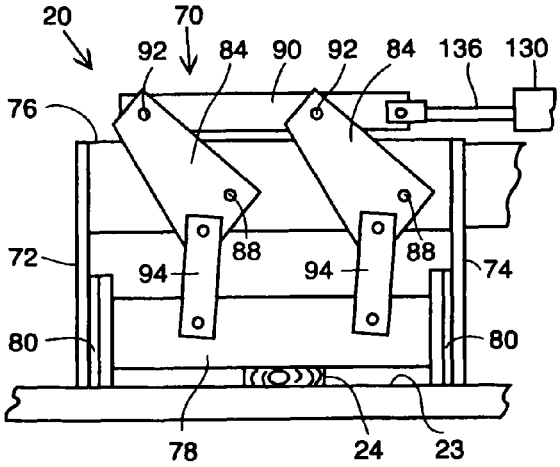
FIG. 7 is a front elevation view of the workpiece-holding clamp of the FIG. 1 system, shown in a workpiece-clamping condition.
Figure 8:
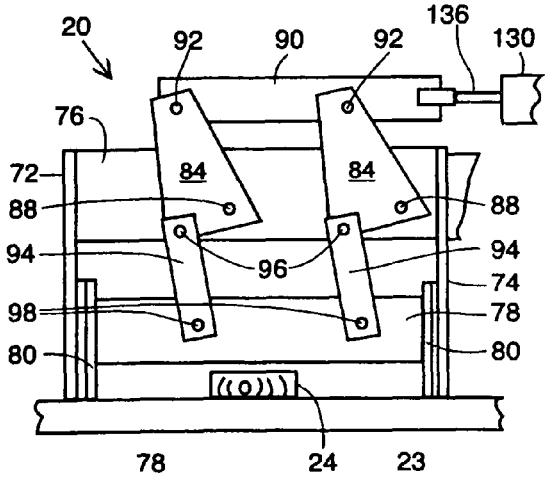
FIG. 8 is a front elevation view of the workpiece-holding clamp of the FIG. 1 system, shown in a release position at which a workpiece can be positioned within or removed from the clamp.

As best shown in FIGS. 7 and 8, the system 20 also includes means, generally indicated 70, associated with the support means 22 for clamping the workpiece 24 against the support surface 23 and in a condition for being worked upon (i.e. cut) by the cutting heads 28 and 30. In the depicted system 20, the clamping means 70 includes a pair of leg members 72, 74 which are fixedly joined to the support means 22 so as to extend upwardly from the support surface 23 and a brace member 76 which is secured to and extends horizontally between the leg members 72, 74. A clamping bar 78 is also positioned between the leg members 72, 74 for movement toward and away from the support surface 23 (i.e. along the Z-coordinate direction), and guide members 80 are attached to each of the leg members 72, 74 for guiding the movement of the clamping bar 78 along the Z-axis. In addition, a parallel linkage assembly 82 is joined between the brace member 80 and has linkage members, described herein, with which the clamping bar 78 is moved along the Z-coordinate direction between, for example, a raised condition as shown in FIG. 8 at which a workpiece 24 can be positioned beneath or released from the clamping means 70 and a lowered condition as shown in FIG. 7 at which the workpiece 24 is clamped between the support surface 23 and the clamping bar 78.

The linkage members of the parallel linkage assembly 82 include a pair of trapezodial-shaped members 84 which are pivotally connected to the brace member 76 with pivot pins 88 and are pivotally connected to one another along the top thereof by way of a horizontal bar 90 and pivot pins 92 and are further pivotally connected to the clamping bar 78 by way of a pair of elongated members 94 and sets of pivot pins 96, 98. As best shown in FIGS. 7 and 8, the pivot pins 98 (with which the elongated members 94 are attached to the bar 78) are spaced from one another by an appreciable distance (e.g. a spaced distance which is at least as great as the width of the workpiece 24) so that when secured within the clamping means 70, the workpiece 24 is inboard of the pivot pins 98. By moving the horizontal bar 90 laterally between, for example, a leftward position as shown in FIG. 7 and a rightward position illustrated in FIG. 8, the clamping bar 78 is moved between its lowered (e.g. FIG. 7) position and its raised (e.g. FIG. 8) position.

The linkage members 84 of the parallel linkage assembly 82 are configured to provide a mechanical advantage to the application of a downwardly-directed force through the clamping bar 78 upon lateral movement of the horizontal bar 90. In other words, for every pound of force applied to the horizontal bar 90 to urge the bar 60 laterally and thereby urge the clamping bar 78 downwardly, the downwardly-applied force exerted to the workpiece 24 is multipled by a predetermined factor. In the depicted system 20, the mechanical advantage provided by the linkage assembly 82 is three so that for every pound of force applied to the horizontal bar 90 to urge the bar 60 laterally, three pounds of force are applied downwardly toward the workpiece 24 through the clamping bar 78.

For moving the horizontal bar 90 between its leftward (FIG. 7) position and rightward (FIG. 8) position, the clamping means 70 includes a double-acting air cylinder 130 (best shown in FIG. 1) having a cylinder 132 which is connected to the support means 22 by way of the brace member 76 and pivot pin 134 and also having a ram 134 which is connected to the bar 90 by way of a pivot pin 138. Associated with the air cylinder 130 is a source 140 of compressed air for supplying compressed air to the air cylinder 130, when actuated, to thereby move the horizontal bar 90 rightwardly or leftwardly, as desired, to thereby move the clamping bar 78 toward or away from the support surface 23.

It is a feature of the clamping means 70 that when used to clamp a workpiece 24 upon the support surface 23, its parallel linkage assembly 82 generates a downwardly-applied pressure upon the workpiece 24 which is relatively uniform along the length of the clamping bar 78. This is in contrast to clamping arrangements of the prior art apply downwardly-applied pressure upon a workpiece through, for example, a single point. By applying instead downwardly-directed forces to the clamping bar 78 through two spaced-apart linkage members 94 and the spaced-apart pivot pins 98, the downwardly-applied pressure by the clamping bar 78 is substantially the same as a path is traced along the length of the clamping bar 78. This being the case, the clamping means 70 holds the workpiece 24 more securely against undesired movement which may be induced, for example, by pressure applied to the workpiece by the cutting heads 28 and 30 during a profile-forming operation, and the clamping means 70 provides an advantage over clamping arrangements of the prior art in this respect.

With reference again to FIGS. 1 and 2, each cutting head 28 or 30 of the cutting means 26 of the depicted system 20 has a body which defines a plurality of cutting edges along the circumferential periphery thereof so that movement (e.g. along the X-coordinate axis) of a workpiece 24 into engagement with the cutting edges of a cutting head 28 or 30 while the head 28 or 30 is rotated about its rotation axis (indicated 142 or 144, respectively, and oriented parallel to the Z-axis) cuts, or removes, material from the workpiece 24 so that the remainder of the workpiece 24 is provided with a desired profile. As mentioned earlier in connection with the formation of a profile along the linear edge 34 of the workpiece 24 depicted in FIG. 3, upper and lower sections of material can be removed from the workpiece 24 to leave a mid-portion, indicated 44 in FIG. 4, which protrudes from the remainder of the workpiece 24.

It follows that the cutting heads 28 and 30 can be selected to provide the workpiece 24 with a desired profile as the workpiece 24 is passed across the rotating cutting edges of the head 28 or 30. Again and as mentioned earlier, it will be understood that the cutting edges of each cutting head 28 and 30 mirror (e.g. are identical to) the cutting edges of the other head 30 and 28 so that the workpiece profile capable of being cut by one cutting head 28 or 30 is identical to the workpiece profile capable of being cut by the other cutting head 30 or 28. Therefore and as will be apparent herein, whether the workpiece 24 is moved in cutting engagement with the cutting head 28 or with the cutting head 30, the profile formed along the workpiece edge 34 is the same.

Figure 9:
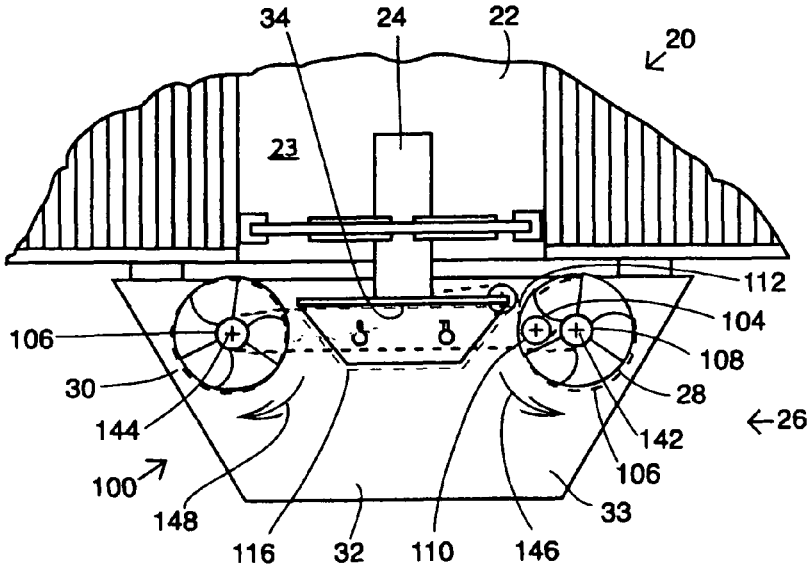
FIG. 9 is a plan view of a fragment of the FIG. 1 system, shown with the workpiece positioned midway between the cutting heads and before the workpiece is worked upon by the cutting heads.

With reference to FIG. 9, it is also a feature of the system 20 that it includes means, generally indicated 100, for rotating the cutting heads 28 and 30 in opposite rotational directions about the rotational axes 142, 144 thereof. In other words, while the cutting heads 28 and 30 are supported for rotation about parallel vertical axes (i.e. axes oriented parallel to the indicated Z-coordinate axis), the rotating means 100 rotates one cutting head 28 in one rotational direction (i.e. counterclockwise as viewed in FIG. 9 and which direction is indicated by the arrow 146) about its rotational axis 142 while the rotating means 100 rotates the other cutting head 30 in the opposite rotational direction (i.e. clockwise as viewed in FIG. 9 and which direction is indicated by the arrow 148).

To this end and as best shown in FIG. 9, each cutting head 28 or 30 is suitably connected to a pulley 104 or 106 journaled below the tabletop 33 of the secondary table 32, and the rotating means 100 includes an electrically-powered motor 106 mounted in a stationary condition below the tabletop 33 of the secondary table 32. Furthermore, a pulley 108 is keyed to the shaft of the motor 106, an idler pulley 110 is rotated mounted beneath the tabletop 33 adjacent the pulley 104, and a belt 112 is positioned about the pulleys 102, 104, 108 and 110 so that actuation of the motor 106 rotates, by way of the belt 112, each of the cutting heads 28 and 30 about its corresponding axis of rotation 142 or 144 in opposite rotational directions.

Figure 10:
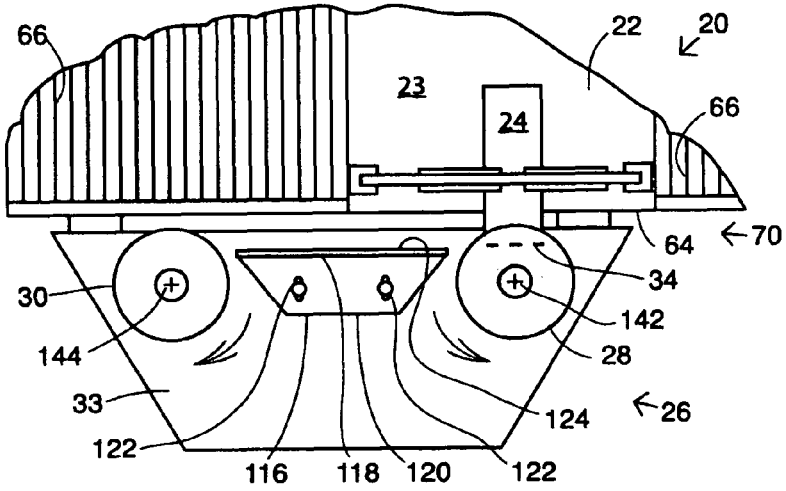
FIGS. 10 and 11 are plan views of a fragment of the FIG. 1 system shown being used to cut a profile along the edge of the workpiece.

With reference to FIG. 10 and for aiding in the positioning of the workpiece 24 at a desired position relative to the desired Y-coordinate axis, the system 20 includes a stop member 116 which is releasably connected to the tabletop 33 of the secondary table 32 in a manner which accommodates an adjustment in position of the stop member 116 relative to the side edge 64 of the tabletop 62 which defines the support surface 23. In this connection and with reference still to FIG. 10, the stop member 116 is L-shaped in cross section having an upstanding platen-like leg section 118 and a platen-like leg section 120 which are joined at a right angle to one another. The leg section 120 includes slot-like openings which are aligned with corresponding openings provided in the tabletop 33. For securement of the stop member 116 to the tabletop 33, the shanks of bolts 122 are directed through the aligned openings, and nuts are tightened upon the shanks of the bolts 122 to secure the stop member 116 in a fixed relationship with the tabletop 33.

The upstanding leg section 118 of the stop member 116 defines a planar abutment surface 124 which is arranged substantially in the indicated X-Z plane and so as to face the edge 64 of the tabletop 62. As will be apparent herein, the planar surface 124 provides an abutment surface against which the linear edge 34 (FIGS. 3 and 4) of the workpiece 24 can be positioned for setting the desired depth of cut of the cutting heads 28, 30 in preparation for movement of the workpiece 24 into cutting engagement with the cutting heads 28, 30. It will also be understood that the distance between the tabletop edge 64 and the abutment surface 124 can be adjusted by loosening the nuts on the bolts 122 and shifting the stop member 116 toward or away from the tabletop edge 64 by a desired amount (between, for example, the position of the stop member 116 illustrated in solid lines in FIG. 9 and the position illustrated in phantom in FIG. 9) and then re-tightening the nuts about the shanks of the bolts 122.

To use the system 20 to cut a profile in the workpiece 24, the support surface 23 (or more specifically, the tabletop edge 64) is substantially centered between the cutting heads 28 and 30 and the workpiece 24 is positioned upon the support surface 23 so that its linear edge 34 (i.e. the workpiece edge along which a profile is desired to be cut) overhangs the tabletop edge 64 and is positioned in abutting relationship with the abutment surface 124 of the stop member 116. With the workpiece 24 arranged upon the support surface 23 in this manner (and in the position shown in FIG. 9), the linear edge 34 of the workpiece 24 extends between the cutting heads 28, 30. If necessary, the position of the stop member 116 relative to the tabletop edge 64 may have to be adjusted to adjust the depth of cut of the cutting heads 28, 30 into the workpiece 24 as the workpiece edge 34 is moved past the cutting heads 28, 30. After positioning the workpiece 24 in a desired position atop the support surface 23, the clamping means 70 is used to clamp the clamping bar 78 upon the workpiece 24 to rigidly secure the workpiece 24 in a stationary relationship with the support surface 23.

The motor 106 is then actuated so that the cutting heads 28 and 30 are rotated about their rotation axes 142 and 144 and in opposite rotational directions. At that point, the support surface 23 is slidably moved relative to the guide rails 54 and along an X-coordinate direction to move the workpiece 24 into cutting engagement with the cutting head 28 before reversing the direction of the support surface 23 along the guide rails 54 to move the workpiece 24 into cutting engagement with the cutting head 30. As mentioned earlier and during a cutting operation performed upon the workpiece 24, the workpiece 24 is moved into cutting engagement with the cutting head 28 as the side edge 40 (FIG. 3) of the workpiece 24 acts as the leading edge which moves toward and first engages the cutting head 28. Due to the rotational direction of the cutting head 28 relative to the workpiece 24 and while it is the side edge 40 of the workpiece 24 which is first engaged by the cutting edges of the cutting head 28, it is the leading edge 34 of the workpiece 24 through which the cutting edges of the cutting head 28 exit the workpiece 24.

Along the same lines, as the workpiece 24 is moved into cutting engagement with the cutting head 30, it is the side edge 42 (FIG. 3) of the workpiece 24 which acts as the leading edge which moves toward and is first engaged by the cutting edges of the cutting head 30. Furthermore and due to the rotational direction of the cutting head 30 relative to the workpiece 24 and while it is the side edge 42 of the workpiece 24 which is first engaged by the cutting edges of the cutting head 30, it is the leading edge 34 of the workpiece 24 through which the cutting edges of the cutting head 30 exit the workpiece 24.

Therefore and following actuation of the motor 106 so that each of the cutting heads 28 and 30 is rotated about its axis (and in a direction opposite the other of the cutting head 30 or 28), the support surface 23 is slidably moved (e.g. by appropriate means) in an initial direction relative to the guide rails 54 (i.e. along either the positive or negative X-coordinate direction) to move the workpiece 24 into engagement with the cutting edges of the corresponding cutting head 28 or 30 for removal of material from the workpiece 24. Even after the workpiece 24 has been moved into cutting engagement with the cutting head 28 or 30, the workpiece 24 continues to be moved (as the support surface 23 continues to be moved) along the initial direction for a distance therealong which is shorter than would be required for the cutting edges of the head 28 or 30 to exit the workpiece 24 by way of the trailing edge—which could be either the workpiece side edge 40 or 42 depending upon which cutting head the workpiece 24 is initially moved toward.

In other words, the workpiece 24 should not be moved in its initial (X-coordinate) direction so far past the rotating cutting edges of the head 28 or 30 toward which the workpiece 24 is first moved so that the cutting edges of the head 28 or 30 exit the workpiece 24 through the side edge thereof which acts as the trailing edge. In practice and to avoid moving the workpiece 24 too far past the cutting edges of the cutting head 28 or 30, it is preferable that the workpiece 24 be moved along its initial direction and into the cutting head 28 or 30 until slightly more than about one half of the linear edge 34 of the workpiece 24 has moved past the cutting tool 28 or 30 or, stated another way, until the midpoint of the linear edge 34 of the workpiece 24 moves along the X-coordinate direction until it moves closest to, or slightly past, the rotational axis of the cutting tool 28 or 30 toward which the workpiece 24 is initially moved. By way of example, there is depicted in FIG. 10 the relative position between the workpiece 24 and the cutting head 28 when the midpoint of the linear edge 334 has moved in the positive X-coordinate direction slightly past the rotational axis 142 of the cutting head 28.

Upon completion of the desired amount of cut in the workpiece 24 (e.g. so that the midpoint of the linear edge 34 is moved closest to, or slightly past, the rotational axis of the cutting tool 28 or 30 toward which the workpiece 24 is first moved, the movement of the support surface 23 in the initial direction along the X-coordinate direction is halted, and the support surface 23 is thereafter moved in the opposite direction along the X-coordinate direction to move the workpiece 24 into cutting engagement with the other, or second, cutting head 30 or 28. It will be understood that as the workpiece 24 is moved in the opposite direction along the X-coordinate direction toward the second cutting head 30 or 28, the side edge 42 or 40 of the workpiece 24 which acted as the trailing edge as the workpiece 24 was moved toward the first cutting head 28 or 30 now acts as the leading edge which is first engaged by the cutting edges of the second cutting head 30 or 28. Again and due to the direction of rotation of the second cutting head 30 or 28 about its axis of rotation, the cutting edges of the second cutting head 30 or 28 first engage the leading (side) edge of the workpiece 24 and exit the workpiece 24 through the linear edge 34 thereof.

Figure 11:
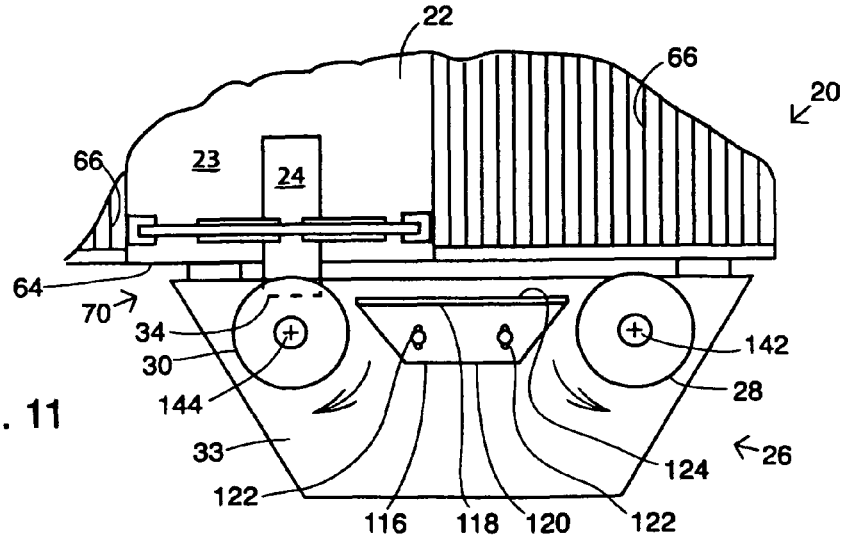

The workpiece 24 continues to be advanced in the opposite direction (i.e. the direction along the X-coordinate axis opposite the initial direction) until the cutting edges of the second cutting head 30 or 28 effect the completion of the desired profile along the linear edge 34 of the workpiece 24. If, for example, removal of material from the workpiece 24 by the first cutting tool 28 or 30 toward which the workpiece 24 was first moved was halted when the midpoint of the linear edge is closest to, or moves slightly past, the rotational axis of the first cutting tool 28 or 30, then the profiling operation performed along the entire length of the leading edge 34 will have been completed when the workpiece 24 has moved in cutting engagement with the second cutting head 30 or 28 as soon as the midpoint of the linear edge 34 reaches, or moves closest to, the rotational axis of the second cutting head 30 or 28. By way of example, there is depicted in FIG. 11 the relative position between the workpiece 24 and the cutting head 30 when the midpoint of the workpiece edge 34 has moved in the negative X-coordinate direction slightly past the rotational axis 144 of the cutting head 30. Upon completion of the profile-forming operation, the workpiece 24 can be returned to its initial (e.g. FIG. 9) position between the cutting heads 28 and 30 and subsequently released from its clamped condition for use in its desired application.

It follows that the system 20 permits the formation of a profile along the entirety of the linear edge 34 of the workpiece 34 without ever requiring that the cutting edges of the cutting heads 28 and 30 used to remove material from the workpiece 24 ever exit a trailing (side) edge of the workpiece 24. Consequently, damage to (e.g. splintering of) the workpiece 24 which could otherwise result as the cutting edges of a cutting head 28 or 30 exit the trailing (side) edge of the workpiece 24, 30 is obviated. Furthermore, a profile-forming operation performed with the system 20 does not require that a sacrificial workpiece be secured adjacent the trailing (side) edge of the workpiece 24. Accordingly, the system 20 and the associated method of forming a profile in a workpiece 24 is advantageous in this respect.

Figure 12:
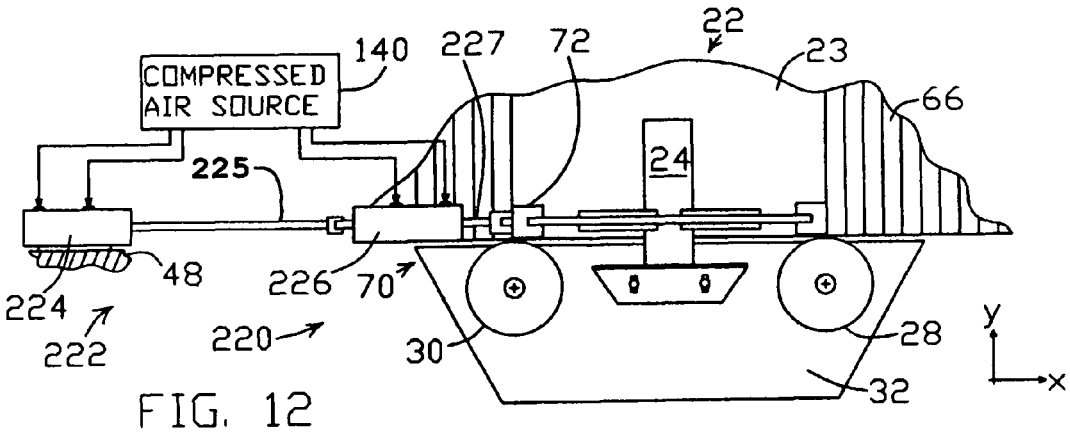
FIGS. 12-14 are plan views of a fragment of an alternative system like that of FIG. 1 schematically depicting exemplary means for moving the workpiece-supporting table of the system between the cutting heads of the system.
Figure 13:
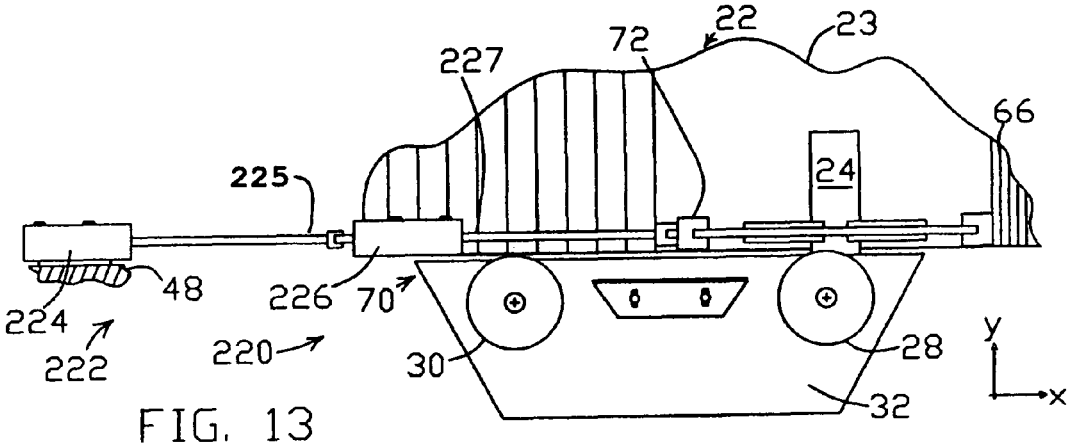
Figure 14:
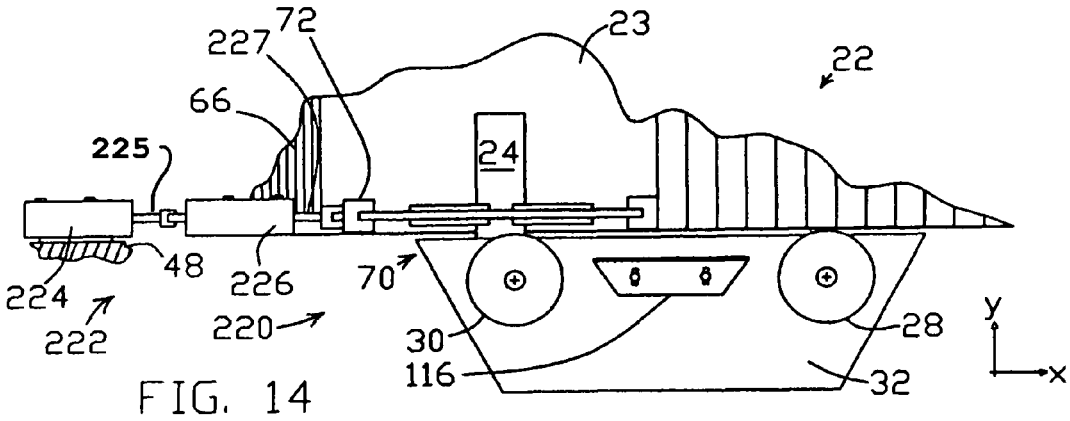

It will be understood that numerous modifications and substitutions can be had to the aforedescribed embodiment without departing from the spirit of the invention. For example, a system in accordance with the present invention can be provided with means for moving the support surface 23 along the positive and negative X-coordinate directions between the cutting heads 28, 30 in a manner which provides accurate control of the distance that the support surface 23 is moved in fore and aft directions along the X-coordinate axis. For example, there is illustrated in FIGS. 12-14 a system 220 having a support surface 23 and means for automatically moving, indicated 222, the support surface 23 along positive and negative X-coordinate directions by a prescribed amount. Other components of the system 220 which are identical to those of the system 20 of FIG. 1 accordingly bear the same reference numerals.

Within the system 220, the moving means 222 includes a first double-acting air cylinder 224 whose body is fixed in relation to the frame 48 and a second double-acting air cylinder 226 which is connected (i.e. in series) between the cylinder 224 and the clamping means 70. More specifically, the cylinder 224 has a ram 225 which is joined to the body of the cylinder 225, and the cylinder 226 has a ram 227 which is joined to the leg member 72 of the clamping means 70. In addition, each cylinder 224 and 226 is connected to the compressed air source 140 (FIG. 12) for receiving air therefrom for moving the rams 225 and 227 of the cylinders 224 and 226 relative to and along the length of the cylinder bodies between fully extended and fully retracted conditions.

In the FIG. 12 view, the workpiece 24 is positioned midway between the cutting heads 28 and 30 (in an initial X-coordinate position) while the ram 225 of the cylinder 224 is fully extended and the ram 227 of the cylinder 226 is fully retracted; in the FIG. 13 view, the workpiece 24 has been moved from the initial FIG. 12 position and one-half way through the cutting head 28 (along the positive X-coordinate direction) while the rams 225 and 227 of both cylinders 224 and 226 are fully extended; and in the FIG. 14 view, the workpiece 24 has been moved from the FIG. 13 position and one-half way through the cutting head 30 (along the negative X-coordinate direction) while the rams 225 and 227 of both cylinders 224 and 226 are fully retracted.

It follows that the workpiece 24 can be moved from the initial FIG. 12 position to the FIG. 13 position, then to the FIG. 14 position, and finally back to the initial FIG. 12 position by actuating the cylinders 224 and 226 in an appropriate sequence, i.e. so that only the ram 227 of the cylinder 226 is moved to its FIG. 13 fully extended condition (so that the workpiece 24 is cut with the cutting head 28 to the desired extent), then so that both rams 225 and 227 of the cylinders 224 and 226 are moved to the FIG. 14 fully retracted condition (so that the workpiece 24 is cut with the cutting head 30 to the desired extent), and then so that only the ram 225 of the cylinder 224 is moved to its FIG. 12 condition (so that the finished workpiece 24 is returned to the initial position for removal of the workpiece 24). It also follows that by selecting the length of travel of the rams 225 and 227 along the bodies of the corresponding cylinders 224 and 226, the limit of travel of the workpiece 24 along the positive and negative X-coordinate directions can be accurately controlled, and the moving means 222 is advantageous in this respect.

Figure 15:
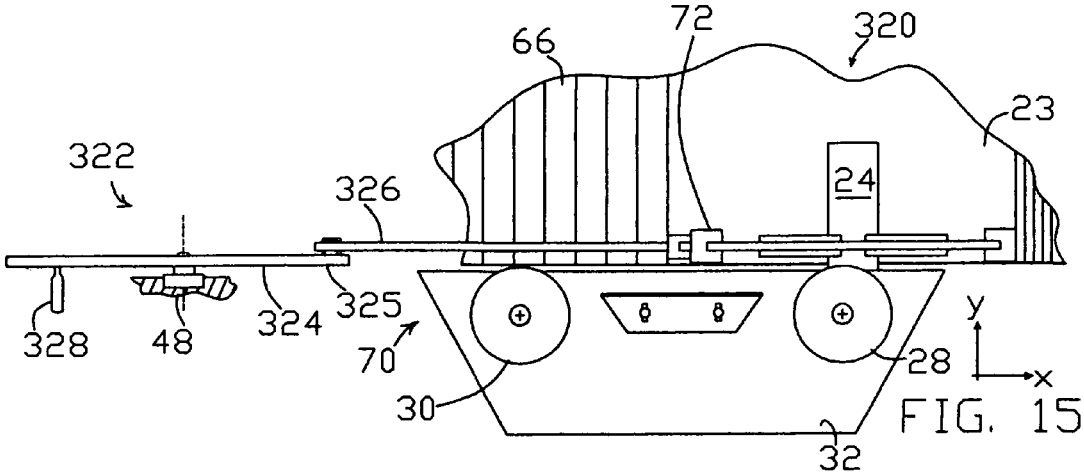
FIGS. 15 and 16 are plan views of a fragment of another system like that of FIG. 1 schematically depicting alternative means for moving the workpiece-supporting table of the system between the cutting heads of the system.
Figure 16:
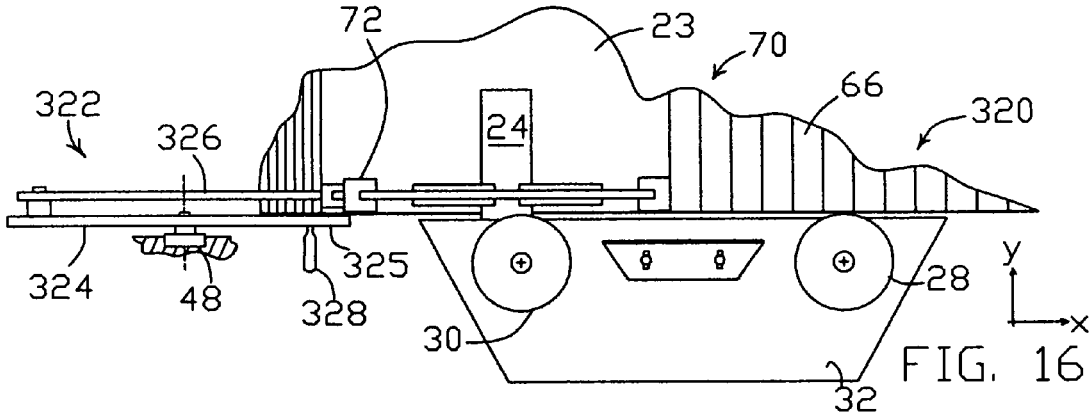
Figure 17:
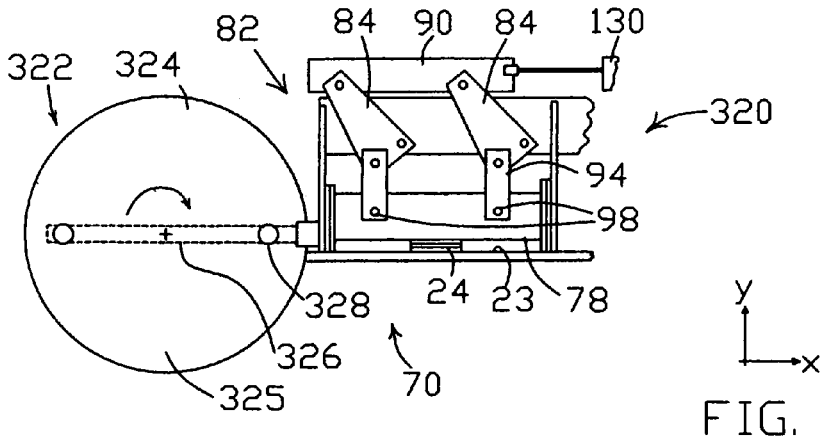
FIG. 17 is a front elevational view of the system fragment illustrated in FIG. 16 but shown with the cutting heads removed therefrom and drawn to a slightly smaller scale.

Furthermore, a system embodying features of the present invention can employ alternative means for moving the workpiece 24 between the cutting heads 28 and 30. For example, there is illustrated in FIGS. 15-17 a system 320 having a support surface 23 and means for moving, indicated 322, for moving the support surface 23 along positive and negative X-coordinate directions between two (i.e. forward and rearward) limits of travel. Other components of the system 320 which are identical to those of the system 20 of FIG. 1 accordingly bear the same reference numerals. Within the system 320, the moving means 322 includes a rotatable crank 324 (in the form of a wheel 325) which is mounted for rotation relative to the frame 48 and a drive rod 326 which is journaled at one end to the crank 324 at a location thereon which is spaced from the rotation axis of the crank 324 and which is pivotally connected at its other end to the leg member 72 of the clamping means 70. As the crank 324 is rotated about its rotation axis (by way, for example, a handle 328 associated with the crank 324), the end of the drive rod 326 which is connected to the leg member 72 of the clamping means 70 is moved, or reciprocated, relative to the frame 48 fore and aft (along the X-coordinate axis) and between forward and rearward limits of movement. As the drive rod 326 reciprocates between its forward and rearward limits of movement in this manner, the workpiece support surface 23 is moved between its two limits of travel by a corresponding amount. It follows that by selecting the length of the drive rod 326 and its relationship to the crank 3324 to thereby select the limits of the length of travel (i.e. the fore and aft movement) of the drive rod 326 along the X-coordinate axis, the limits of travel of the workpiece 24 along the positive and negative X-coordinate directions can be accurately controlled.

Accordingly, the aforedescribed embodiment is intended for the purpose of illustration and not as limitation.

The invention claimed is:

1. A system for cutting a profile along the linear edge of a workpiece having a linear edge and two side edges between which the linear edge extends, the system comprising:

a pair of rotatable cutting tools which are supported for rotation about parallel axes and in a spaced-apart relationship with one another and having cutting edges so that when either of the cutting tools is rotated about its rotation axis and the linear edge of a workpiece is moved in cutting engagement with and along the cutting edges of the rotating cutting tool, material is removed from the workpiece to form a profile along the linear edge thereof;

means for supporting the workpiece in condition to be cut by the cutting tools as the linear edge of the workpiece is moved in cutting engagement with and along the cutting edges of the cutting tools; and means for rotating the cutting tools in opposite rotational directions about the axes of rotation so that by arranging the workpiece upon the means for supporting so that the linear edge of the workpiece extends between the cutting tools and then moving the workpiece in an initial direction into cutting engagement with the cutting edges of one of the cutting tools so that a side edge of the workpiece which acts as the leading edge of the workpiece is the first edge of the workpiece to be engaged by the cutting edges of said one of the cutting tools, halting the movement of the workpiece in the initial direction before the cutting edges of said one of the cutting tools exits the workpiece through a side edge thereof which acts as the trailing edge, and then moving the workpiece in the direction opposite the initial direction so that material is removed from the workpiece by the other cutting tool, the linear edge of the workpiece is profiled along its entire length; and the means for supporting defines a substantially planar support surface upon which the workpiece can be positioned and which extends along X and Y coordinate axes so then when the workpiece is positioned upon the support surface, the linear edge of the workpiece extends along a path which is substantially parallel to the X-coordinate axis;

the cutting tools are adapted to rotate about axes which are parallel to the Z-coordinate axis;

the support surface is supported for movement relative to the cutting tools along positive and negative X-coordinate directions so that by moving the support surface relative to the cutting tools as aforesaid, the linear edge of the workpiece is moved into cutting engagement with the cutting tools; and clamping means associated with the support surface for releasably clamping the workpiece upon the support surface and in a condition to be cut by the cutting tools wherein the clamping means includes an elongated clamping bar arranged so that its longitudinal axis is substantially parallel to the X-coordinate axis and mounted for movement toward and away from the support surface along the Z-coordinate direction, and the clamping means further includes a parallel linkage assembly which is pivotally connected to the clamping bar enabling the clamping bar to be moved toward and away from the support surface as the linkage assembly is pivotally moved relative to the clamping bar so that when the clamping bar is used to clamp a workpiece against the support surface, the clamping pressure exerted against the workpiece by the clamping bar is relatively uniform as a path is traced along the clamping bar.

2. The system as defined in claim 1 wherein the cutting edges of the pair of cutting tools mirror one another so that the profiles formed along the linear edge of the workpiece by the cutting tools are identical to one another.

3. The system as defined in claim 1 further including an actuatable cylinder assembly connected between the means for supporting and the parallel linkage assembly so that by actuating the cylinder assembly, the linkage assembly is pivotally moved relative to the clamping bar to thereby move the clamping bar toward or away from the support surface.

4. The system as defined in claim 1 wherein the means for rotating the cutting tools includes a single motor.

5. The system as defined in claim 1 further including means for moving the workpiece between the cutting tools where the workpiece is cut by the cutting tools and between two limits of travel so that movement of the cutting tool into cutting engagement with either cutting tool beyond a preselected distance is automatically prevented.

6. The system as defined in claim 5 further comprising a frame upon which the means for supporting is movably mounted, and wherein the means for moving includes means which is connected to the means for supporting for reciprocating the means for supporting relative to the frame and in fore and aft directions between forward and rearward limits of movement so that the two limits of travel between which the means for supporting is moved by the means for moving corresponds to the forward and rearward limits of travel of the means for supporting.

7. The system as defined in claim 6 wherein the means for reciprocating includes a crank which is rotatably mounted upon the frame and an elongated rod having two opposite ends, and one end of the rod is connected to the crank at a location thereon which is spaced from the rotational axis of the crank and the other end of the rod is connected to the workpiece supporting means so that rotation of the crank about its rotation axis reciprocates said other end of the rod relative to the frame so that the workpiece supporting means is thereby reciprocated in fore and aft directions between forward and rearward limits of movement.

8. A system for cutting a profile along the linear edge of a workpiece having two side edges between which the linear edge extends, the system comprising:

a pair of rotatable cutting tools which are supported for rotation about parallel axes and in a spaced-apart relationship with one another and having cutting edges so that when either of the cutting tools is rotated about its rotation axis and the linear edge of a workpiece is moved in cutting engagement with and along the cutting edges of the rotating cutting tool, material is removed from the workpiece to form a profile along the linear edge thereof;

means for supporting the workpiece in condition to be cut by the cutting tools as the linear edge of the workpiece is moved in cutting engagement with and along the cutting edges of the cutting tools; and means for rotating the cutting tools in opposite rotational directions about the axes of rotation so that by arranging the workpiece upon the means for supporting so that the linear edge of the workpiece extends between the cutting tools and then moving the workpiece in an initial direction into cutting engagement with the cutting edges of one of the cutting tools so that a side edge of the workpiece which acts as the leading edge of the workpiece is the first edge of the workpiece to be engaged by the cutting edges of said one of the cutting tools, halting the movement of the workpiece in the initial direction before the cutting edges of said one of the cutting tools exits the workpiece through a side edge thereof which acts as the trailing edge, and then moving the workpiece in the direction opposite the initial direction so that material is removed from the workpiece by the other cutting tool, the linear edge of the workpiece is profiled along its entire length; and means for moving the workpiece between the cutting tools where the workpiece is cut by the cutting tools and between two limits of travel so that movement of the cutting tool into cutting engagement with either cutting tool beyond a preselected distance is automatically prevented; and a frame upon which the means for supporting is movably mounted, and wherein the means for moving includes a pair of double-acting cylinders which are connected in series between the frame and the means for supporting so that the workpiece can be moved between and into cutting engagement with the cutting tools by actuating the double-acting cylinders in a predetermined sequence.

9. The system as defined in claim 8 wherein each of the double-acting cylinders includes a body and a ram which is moveable relative to the body between fully extended and fully retracted conditions, and the distance between the limits of travel of the means for supporting between the cutting tools is determined by the difference in length between the double-acting cylinders when the rams thereof are fully extended and when the rams thereof are fully retracted.

10. A system for forming a profile along a linear edge of a wooden workpiece having two side edges between which the linear edge extends, the system comprising:

means for supporting a workpiece which defines a support surface which extends along X- and Y-coordinate axes and which is capable of being moved along X-coordinate directions, and the support surface is adapted to support a workpiece positioned thereon for movement therewith along the X-coordinate directions;

a first rotatable cutting tool mounted for rotation adjacent the support surface about a rotation axis which is parallel to the Z-coordinate axis and having cutting edges for removing a first amount of material from the workpiece as the first cutting tool is rotated and the linear edge of the workpiece is moved in cutting engagement with the first cutting tool;

a second rotatable cutting tool mounted for rotation adjacent the support surface about a rotation axis which is parallel to the Z-coordinate axis and having cutting edges for removing a second amount of material from the workpiece as the second cutting tool is rotated and the linear edge of the workpiece is moved in cutting engagement with the second cutting tool;

means for rotating the first and second cutting tools in opposite rotational directions about the rotation axes thereof so that as the linear edge of the workpiece is moved in an initial X-coordinate direction toward the first cutting tool, the workpiece is first engaged by the cutting edges of the first cutting tool along a side edge of the workpiece that the leads the workpiece toward the first cutting tool and so that as the linear edge of the workpiece is moved in an X-coordinate direction opposite the initial direction toward the second cutting tool, the workpiece is first engaged by the cutting edges of the second cutting tool along a side edge of the workpiece that the leads the workpiece toward the second cutting tool; and the first cutting tool and the second cutting tool are arranged in spaced relationship with one another to accommodate the positioning of the workpiece between the first and second cutting tools so that the linear edge thereof extends along a path parallel to the X-coordinate axis and so that by rotating the cutting tools about the rotation axes thereof, moving the workpiece in an initial X-coordinate direction toward the first cutting tool so that a first amount of material is removed from the workpiece as the linear edge thereof is moved in cutting engagement with the first cutting tool, then halting the movement of the workpiece in the initial direction before the cutting edges of the first cutting tool exit the workpiece through a side edge thereof which trails the workpiece, and then reversing the direction of movement of the workpiece from the initial X-coordinate direction and toward the second cutting tool so that a second amount of material is removed from the workpiece as the linear edge thereof is moved into cutting engagement with the second cutting tool, the linear edge of the workpiece is profiled along its entire length; and clamping means associated with the support surface for releasably clamping the workpiece upon the support surface and in a condition to be cut by the cutting tools wherein the clamping means includes an elongated clamping bar arranged so that its longitudinal axis is substantially parallel to the X-coordinate axis and mounted for movement toward and away from the support surface along the Z-coordinate direction, and the clamping means further includes a parallel linkage assembly which is pivotally connected to the clamping bar enabling the clamping bar to be moved toward and away from the support surface as the linkage assembly is pivotally moved relative to the clamping bar so that when the clamping bar is used to clamp a workpiece against the support surface, the clamping pressure exerted against the workpiece by the clamping bar is relatively uniform as a path is traced along the clamping bar.

11. The system as defined in claim 10 further including an actuatable cylinder assembly connected between the means for supporting and the parallel linkage assembly so that by actuating the cylinder assembly, the linkage assembly is pivotally moved relative to the clamping bar to thereby move the clamping bar toward or away from the support surface.

12. The system as defined in claim 10 wherein the means for rotating the cutting tools includes a single motor, a belt connected in driven relationship to the motor, and a network of pulleys across which the belt is routed so that actuation of the motor rotates the first and second cutting tools in opposite rotational directions.

13. The system as defined in claim 10 further including means for moving the workpiece between the cutting tools where the workpiece is cut by the cutting tools and between two limits of travel so that movement of the cutting tool into cutting engagement with either cutting tool beyond a preselected distance is automatically prevented.

* * * * *